US006851781B2

(12) United States Patent
Yokoyama

(10) Patent No.: US 6,851,781 B2
(45) Date of Patent: Feb. 8, 2005

(54) PRINTING APPARATUS CONTROLLING METHOD, PRINTING APPARATUS CONTROLLING PROGRAM, RECORDING MEDIUM FOR STORING PRINTING APPARATUS CONTROLLING PROGRAM AND PRINTING SYSTEM

(75) Inventor: Toshihiko Yokoyama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/358,875

(22) Filed: Feb. 5, 2003

(65) Prior Publication Data

US 2003/0169309 A1 Sep. 11, 2003

(30) Foreign Application Priority Data

Feb. 20, 2002 (JP) ..... 2002-043963

(51) Int. Cl.[7] ..... B41J 29/38

(52) U.S. Cl. ..... 347/14; 347/192; 358/1.14

(58) Field of Search ..... 347/5, 14, 16, 347/19, 192; 320/134; 324/426; 358/1.14, 1.15; 399/37

(56) References Cited

U.S. PATENT DOCUMENTS

| | | | | | |
|---|---|---|---|---|---|
| 5,515,087 | A | * | 5/1996 | Lim et al. | 347/19 |
| 5,673,070 | A | * | 9/1997 | Nakanishi et al. | 347/19 |
| 5,714,994 | A | | 2/1998 | Suzuki et al. | 347/190 |
| 5,818,474 | A | * | 10/1998 | Takahashi et al. | 347/15 |
| 5,902,054 | A | | 5/1999 | Coudray | 400/120.01 |
| 6,031,302 | A | * | 2/2000 | Levesque | 307/130 |
| 6,095,700 | A | | 8/2000 | Negishi et al. | 400/120.02 |
| 6,497,468 | B1 | * | 12/2002 | Otsuka | 347/16 |

FOREIGN PATENT DOCUMENTS

| | | | | |
|---|---|---|---|---|
| EP | 0 587 385 | | 3/1994 | |
| EP | 0 820 184 | | 1/1998 | |
| EP | 893753 | A2 * | 1/1999 | G06F/3/12 |
| EP | 1 046 979 | | 10/2000 | |
| JP | 6-71983 | | 3/1994 | |
| JP | 6-286202 | | 10/1994 | |
| JP | 7-132650 | | 5/1995 | |
| JP | 7-314837 | | 12/1995 | |
| JP | 10-250132 | | 9/1998 | |
| JP | 2000-071580 | | 7/2000 | |
| JP | 2000-326529 | | 11/2000 | |
| JP | 2001-047656 | | 2/2001 | |

OTHER PUBLICATIONS

European Search Report for EP 1 346 837 dated Oct. 22, 2003.

* cited by examiner

*Primary Examiner*—Lamson Nguyen
*Assistant Examiner*—Blaise Mouttet

(57) ABSTRACT

A printing apparatus is controlled by obtaining status information of battery power of the printing apparatus (S101), determining a present status of the battery power from the obtained status information (S102), establishing a process mode so as to produce data for controlling the printing apparatus according to the present status of the battery power (S103 to S105) and controlling an operation of the printing apparatus by means of normal data or power saving data produced in the established process mode. In a power saving process mode, power saving print data and power saving control data are produced for lowering power consumption of the printing apparatus.

31 Claims, 8 Drawing Sheets

BATTERY STATUS DETERMINING PROCESS
S401
DETECT BATTERY POWER STATUS
S402
BATTERY POWER STATUS IS CHANGED?
NO
YES
S403
PRODUCE STATUS DATA
S404
AUTO STATUS BACK FUNCTION IS INSTALLED?
NO
YES
S405
STATUS TRANSMISSION IS REQUESTED?
NO
YES
S406
TRANSMIT BATTERY STATUS DATA
S407
TRANSMISSION FINISHED
NO
YES

PRINTING APPARATUS CONTROLLING METHOD, PRINTING APPARATUS CONTROLLING PROGRAM, RECORDING MEDIUM FOR STORING PRINTING APPARATUS CONTROLLING PROGRAM AND PRINTING SYSTEM

FIELD OF THE INVENTION

The present invention relates to control of a printing operation of a battery-operated printing apparatus. Particularly, the present invention relates to a method for controlling an operation of a printing apparatus in accordance with a remaining amount of the battery power and a printing system therefor.

RELATED ART

In view of higher printing quality being demanded, a printing apparatus preferably performs printing in a status that it can be continuously supplied with necessary power required for printing. For the same point of view, even a conventional battery-operated printer requires a higher current supply capability for discharged current to keep high printing quality. Printing is therefore indiscriminately stopped well before the current supply capability of the battery power is largely decreased.

However, if the printing is indiscriminately stopped when an output of the battery power decreases below a predetermined voltage level, and at the same time high printing quality is required to be maintained, the remaining amount of the battery is need to be replaced before the battery power is fully used out. This is not only wasteful but also takes a lot of trouble with charging in the battery or replacing batteries. Besides, once the output of the battery power decreases to a predetermined voltage level during printing, the printing is need to be restarted after replacing batteries or charging in the battery. These works are troublesome especially for users where the printing apparatus is far away from a host device with the use of radio LAN or the like.

SUMMARY OF THE INVENTION

A printing apparatus controlling method according to an embodiment of the present invention is a method for controlling an operation of a battery-operated printing apparatus according to a remaining amount of battery power, the printing apparatus executing required printing based on received control data and print data, which comprises steps of:

(a) obtaining status information indicating a present status of said battery power from the printing apparatus to determine a remaining amount of said battery power;

(b) establishing one of a normal process mode, a power saving process mode and a print stop mode on a basis of a determined remaining amount, said normal process mode being in a first status where the remaining amount of the battery power is at least a predetermined amount, said power saving process mode being in a second status where the remaining amount of the battery power is lower than that of the first status, and said print stop mode being in a third status where the remaining amount of the battery power is lower than that of the second status;

(c) upon receiving a print request, producing normal data comprising normal control data and normal print data in said normal process mode to operate the printing apparatus at rated power consumption, producing power saving data including power saving print data in said power saving process mode to enable to print at smaller power consumption than at least power consumption in said normal print data, on a basis of an established mode; and (d) sending to said printing apparatus said normal data produced in said normal process mode, or said power saving data produced in said power saving process mode.

A printing apparatus controlling method according to another embodiment of the present invention is a method in which said power saving print datacomprises print data having a lower print resolution than that of normal print data.

A printing apparatus controlling method according to another embodiment of the present invention is a method in which power saving control data is further produced as said power saving data in said power saving process mode in the step (c) above so as to feed a sheet slower than a feeding speed in said normal process mode.

A printing apparatus controlling method according to still another embodiment of the present invention is a method in which said second status is determined at a plurality of stages, and in the power saving process mode in the step (c) above, different kinds of power saving data are produced corresponding to the respective stages of said second status.

A printing apparatus controlling method according to yet another embodiment of the present invention is a method in which said power saving print data is produced by a logical product (AND) of said normal print data and a mask pattern to prevent prescribed dots from being printed in the step (c) above.

A printing apparatus controlling method according to still yet another embodiment of the present invention is a method in which the step (a) of obtaining status information includes a step of inquiring said status information to the printing apparatus, a step of receiving said status information sent from the printing apparatus in response to the inquiry, and a step of determining a status from said status information received.

Another embodiment of the present invention is a computer program for executing each of the steps of the above method.

Still another embodiment of the present invention is a computer readable storage medium storing a computer program for executing each of the steps of the above method.

A printing system according to an embodiment of the present invention is a printing system capable of controlling an operation based on a remaining amount of a battery power, comprising:

a printing apparatus including a battery used as a drive source, a transmission/reception processing portion for sending and receiving data, a printing portion executing a printing on a basis of received control data and print data, a detecting portion detecting a status of said battery, and a status processing portion producing status information which shows a remaining amount of said battery on a basis of a detecting signal from said detecting portion; and a print controller for controlling the printing apparatus by means of sending normal data in a first status and power saving data in a second status, including a transmittion/reception processing portion for sending and receiving data with said printing apparatus, a determining portion for obtaining the status information from the printing apparatus and determining a remaining amount of the battery on a basis of the status information, normal data producing portion for producing normal data to execute a print control by means of a normal process mode in the first status where the remaining amount of the battery power is at least a predetermined amount, a power saving data producing portion for producing power saving data including power saving data to enable to print at smaller power consumption than at least power consumption in said normal data to execute a print control by means of a power saving process mode in the second status where the remaining amount of the battery power is lower than that of the first status, and a print stop process portion for stopping printing by means of a print stop mode in a third status where the remaining amount of the battery power is lower than that of the second status.

A printing system according to another embodiment of the present invention is a printing system in which said power saving print data comprises print data having a lower print resolution than that of normal print data.

A printing system according to still another embodiment of the present invention is a printing system in which said power saving print data produced by said power saving producing portion comprises a logical product (AND) of said normal print data and a mask pattern to prevent prescribed dots from being printed.

A printing system according to yet another embodiment of the present invention is a printing system in which said power saving data producing portion produces power saving control data for controlling a paper feed speed to perform paper feed slower than that in the normal process mode.

DETAILED DESCRIPTION OF THE INVENTION

Figure 1:
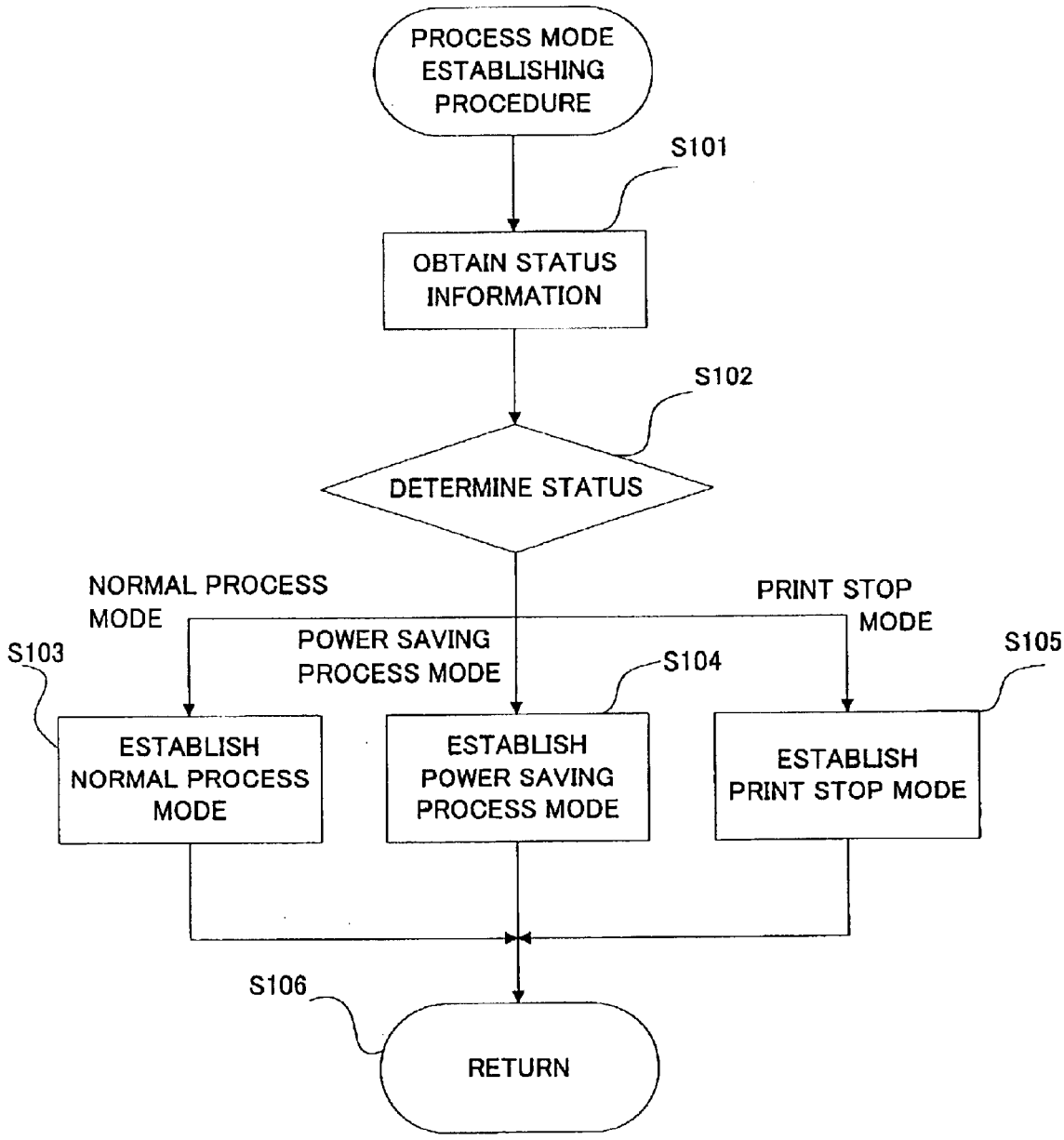
FIG. 1 is a flowchart showing a procedure for establishing a process mode in accordance with a status of battery power of a printing apparatus according to an embodiment of the present invention.

Embodiments of the present invention will now be described with reference to the drawings.

According to the present invention, power consumption can be reduced by obtaining status information indicating a status of battery power of a printing apparatus and, when it is determined from the status information that the battery power remains less than a predetermined value, controlling an operation of the printing apparatus based on a power saving process mode.

It is an object of the present invention to provide a printing apparatus controlling method for controlling an operation of a printing apparatus in accordance with a remaining amount of the battery power of the printing apparatus and a printing system.

Another object of the present invention is to provide a printing apparatus controlling method and a printing system which enable charged battery power to be used more effectively than that in a conventional printing apparatus in a battery-operated printing apparatus.

A printing apparatus controlling method according to an embodiment of the present invention is a method for controlling an operation of a battery-operated printing apparatus according to a remaining amount of battery power, the printing apparatus executing required printing based on received control data and print data, which comprises steps of:

(a) obtaining status information indicating a present status of said battery power from the printing apparatus to determine a remaining amount of said battery power;

(b) establishing one of a normal process mode, a power saving process mode and a print stop mode on a basis of a determined remaining amount, said normal process mode being in a first status where the remaining amount of the battery power is at least a predetermined amount, said power saving process mode being in a second status where the remaining amount of the battery power is lower than that of the first status, and said print stop mode being in a third status where the remaining amount of the battery power is lower than that of the second status;

(c) upon receiving a print request, producing normal data comprising normal control data and normal print data in said normal process mode to operate the printing apparatus at rated power consumption, producing power saving data including power saving print data in said power saving process mode to enable to print at smaller power consumption than at least power consumption in said normal print data, on a basis of an established mode; and (d) sending to said printing apparatus said normal data produced in said normal process mode, or said power saving data produced in said power saving process mode.

A printing system according to an embodiment of the present invention is a printing system capable of controlling an operation based on a remaining amount of a battery power, comprising:

a printing apparatus including a battery used as a drive source, a transmission/reception processing portion for sending and receiving data, a printing portion executing a printing on a basis of received control data and print data, a detecting portion detecting a status of said battery, and a status processing portion producing status information which shows a remaining amount of said battery on a basis of a detecting signal from said detecting portion; and a print controller for controlling the printing apparatus by means of sending normal data in a first status and power saving data in a second status, including a transmission/reception processing portion for sending and receiving data with said printing apparatus, a determining portion for obtaining the status information from the printing apparatus and determining a remaining amount of the battery on a basis of the status information, a normal data producing portion for producing normal data to execute a print control by means of a normal process mode in the first status where the remaining amount of the battery power is at least a predetermined amount, a power saving data producing portion for producing power saving data including power saving data to enable to print at smaller power consumption than at least power consumption in said normal print data to execute a print control by means of a power saving process mode in a second status where the remaining amount of the battery power is lower than that of the first status, and a print stop process portion for stopping printing by means of a print stop mode in a third status where the remaining amount of the battery power is lower than that of the second status.

Now, description is given in more detail below.

Figure 6:
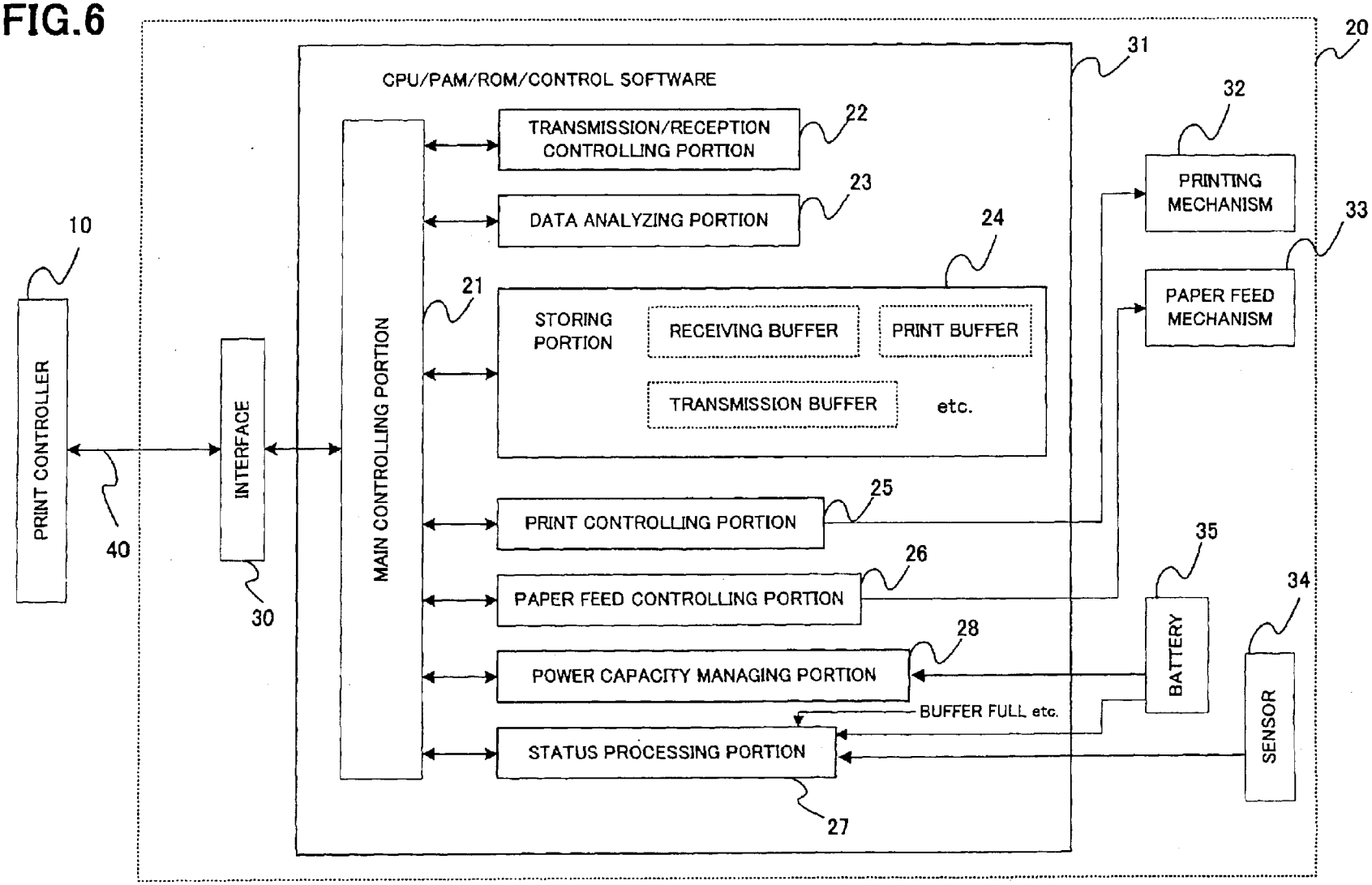
FIG. 6 is a functional block diagram showing an embodiment of a printing apparatus used in a printing system of the present invention.

FIG. 1 is a flowchart showing an embodiment of a procedure of establishing a process mode according to a status of battery power of a printing apparatus in a method for controlling an operation of the printing apparatus of the present invention. FIG. 6 is a functional block diagram illustrating an embodiment of a printing apparatus used in a printing system of the present invention.

The procedure shown in the flowchart of FIG. 1 is applicable to the printing system, as shown in FIG. 6, in which control data, print data and the like are sent from a print controller 10 to a battery-operated printing apparatus 20 to control an operation of the printing apparatus 20. In the present embodiment, the print controller 10 produces each print dot data to be printed and sends the produced dot data to the printing apparatus 20 as print data. Here, in this specification, the battery power includes an electric cell (battery).

As illustrated in FIGS. 1 and 6, the print controller 10 obtains status information on a remaining amount of battery power from the printing apparatus 20 (S101). Obtaining of status information may be performed using various methods: for example, the printing apparatus 20 has in advance a battery information (status information) reporting function, and the print controller 10 sends a battery information (status information) sending command to the printing apparatus 20 and then obtains the status information from the printing apparatus 20. Or, the printing apparatus 20 is instructed in advance to report a status when the amount of remaining battery power becomes lower than a predetermined amount, and then, once the amount of remaining battery power becomes lower than a predetermined amount, the printing apparatus 20 serves an Auto Status Back function to report its status of the battery power. Then, the remaining battery power is determined from the obtained status information (S102) to establish a process mode to prepare data for normalizing and controlling the operation of the printing apparatus 20. Determination result on the status information is stored.

When the battery power has enough discharge capacity (remaining amount) (a first status), a normal process mode (S103) is established. In the normal process mode, there are produced print data and control data for executing a predetermined rated operation in accordance with a resolution specified by a print request program or the like and the capability of the printing apparatus (these data are collectively called normal data). In other words, the operations of printing with a specified resolution, paper feed and the like are executed at a predetermined rated speed.

When the discharge capacity of the battery power is below a predetermined level (a second status), a power saving process mode (S104) is established. In the power saving process mode, in view of the depressed current capability, there are produced print data and control data which allows power consumption to be reduced based on the power saving mode processing (these data are collectively called power saving data). For example, in order to reduce power consumption required to drive a printing apparatus, print data (power saving print data) is produced to be printed at a print resolution lower than that of print data produced at the normal process mode. Further, to reduce power consumed by the paper feed operation, control data for controlling the driving speed of the driving motor for paper feed to be lowered (as one example of the power saving control data) is produced.

When the discharge capacity of the battery power is further decreased below the second status into a status where the printing apparatus can not operate normally (a third status), a print stop mode is established (S105). In the print stop mode, processing for pausing printing is performed, such as processing of responding to the print program with status information that the battery power is not usable and awaiting fresh battery power, processing of issuing an alarm to an operator and the like. The normal data and power saving data produced in each of the modes are sent to the printing apparatus 20 just before completion of the mode processing. Once the mode processing is completed, the print controller 10 gives control of a CPU resource and the like into the hands of a job scheduler or the like (S106). The printing apparatus 20 executes operations of printing, paper feed and the like based on the received data.

The processing procedure shown in the flowchart of FIG. 1 is executed with predetermined timing of obtaining a status of the battery power from the printing apparatus 20 or with timing of receiving status information on the battery power from the printing apparatus 20 by way of the Auto Status Back function. Once any one process mode is determined according to this flowchart, the processing operation is to be executed according to the determined process mode (normal process mode or power saving process mode) until the determination of the status is changed in the present processing procedure (S102).

Description will now be made of processing procedure of each of the process modes. In the normal process mode, there are produced print data (normal print data) and control data (normal control data) for performing printing operation with a normal resolution and at a normal print speed. This processing procedure may utilize the same procedure as that of producing print data (print dot matrix data) which is handled by a printer driver or the like in receiving a printing command from a host device or the like and producing control data including a printing command, a paper feed command and the like. On the other hand, in the print stop mode, the processing for pausing the printing operation is performed, for example, processing of responding to the print program with status information that the battery power is not usable and awaiting fresh battery power, processing of issuing an alarm to an operator and the like, as mentioned above.

Figure 2:
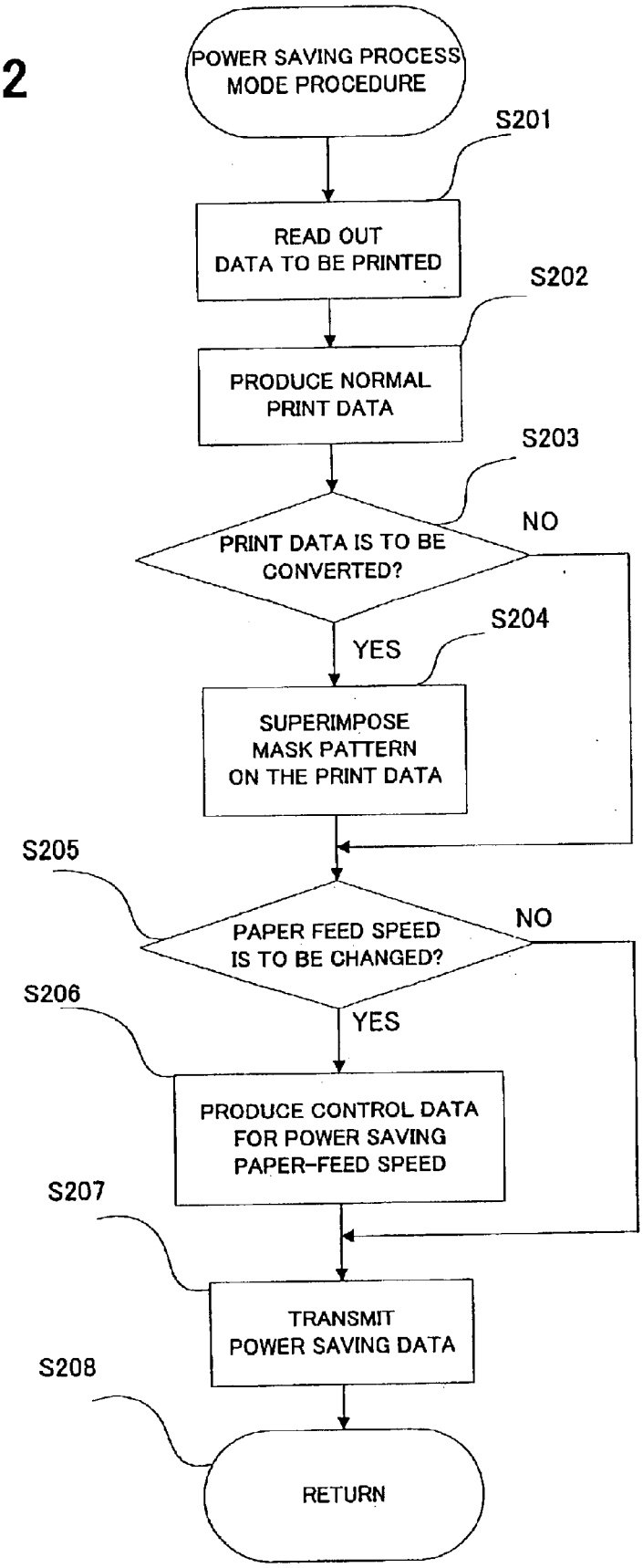
FIG. 2 shows an embodiment of a procedure in the power saving process mode.

With reference to FIG. 2, the power saving process mode is now described. FIG. 2 shows an embodiment of the processing procedure for the power saving process mode. First, data to be printed is read out (S201), and the data is converted to normal print data consisting of print dot data corresponding to the printing apparatus 20 and a specified print resolution defined corresponding to the data to be printed (S202). Then, it is determined whether further conversion of the print data is to be performed or not (S203). When the further conversion of the print data is to be performed (S203; Yes), a predetermined mask pattern is superimposed on the normal data so as not to print predetermined print dots specified by the mask pattern. This allows power saving print data with lowered print resolution to be produced, thereby achieving suppression of the power consumption involved in printing. The processing with the use of a mask pattern will be further described later.

When the further conversion of the print data is not performed (S203; No) or superimposing on a mask pattern is finished (S204), it is determined whether a paper feed speed is to be changed or not (S205). When it is to be changed (S205; Yes), power saving control data (slow line feed mode setting command) is produced for driving a paper feed motor at the paper feed speed lower than the normal paper feed speed (S206). Based on this power saving control data the printing apparatus 20 reduces current to be supplied to the paper feed motor so as to slow the paper feed speed compared with the normal paper feed speed. For a line dot printer, for example, timing of driving a print head is adjusted so as to synthesize the slowed paper feed with driving of the print head.

When the paper feed speed is not changed (S205; No) or production of control data for lowering the paper feed speed (S206) is completed, these print data (normal print data or power saving print data) and control data are sent to the printing apparatus 20 (S207). With this completion of sending the power saving data, the power saving process mode is finished (S208).

In the embodiment of FIG. 2, power saving data is produced by performing either or both of the processing of conversion of the print data (S204) and the processing of producing control data to slow the paper feed speed (S206).

Where the second status of battery power is determined at plural stages, plural kinds of mask patterns for different resolutions may be provided so that a mask pattern in accordance with the battery power status is to be selected. Further, plural power saving data may be produced to lower the paper feed speed step by step. These allow meticulous attention to detail to be paid in controlling of printing operation based on a battery power status.

Figure 3A:
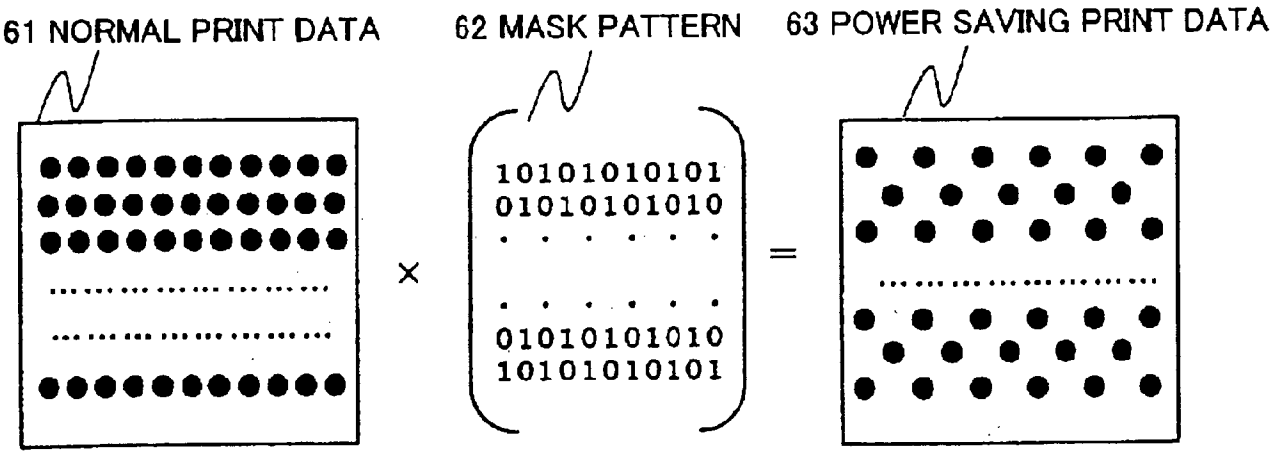
FIG. 3A is a view for describing an image of superimposing processing (S204) of print data on a mask pattern.

FIG. 3A is a conceptual view of superimposing processing (S204) of data on a mask pattern shown in FIG. 2. In case that normal print data 61 consists of a dot-matrix as shown in FIG. 3A, a logical product AND of the normal print data 61 and a mask pattern 62 with <<0>> and <<1>> in a staggered arrangement results in producing power saving print data 63 with dots in a staggered arrangement. When the power saving print data 63 is compared with the normal print data 61, they are the same in size of print images. However, the print dots of the power saving print data 63 is almost half of the dots of the normal print data 61, which means the power saving print data 63 is printed at half resolution. For this reason, although the printing quality is degraded, the print-head driving current is cut in half.

Figure 3B:
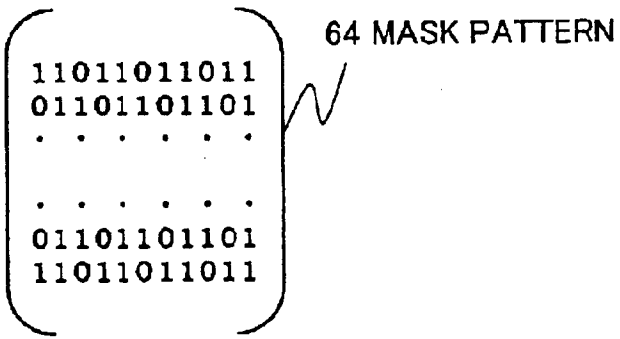
FIG. 3B is a view showing another mask pattern.

The mask pattern 62 may be variously formed in view of the purpose of reducing power consumption, the quality tolerance and so on. FIG. 3B illustrates a mask pattern for printing with one-third resolution of the normal one. In addition, even with similar reduction of resolution, degradation of printing quality can be suppressed by using a corresponding mask pattern to what is to be printed. For example, in printing an image which has an important point in the center thereof but not in the background, a mask pattern which allows the image to be printed with high resolution in the center and low resolution in the background is used thereby to suppress quality degradation but to assure effective power saving in printing. Particularly in a POS printing apparatus or the like which is used to print one image such as logos repeatedly, a mask pattern corresponding to the image is prepared thereby to produce power saving print data appropriate to the image to be printed.

Figure 4:
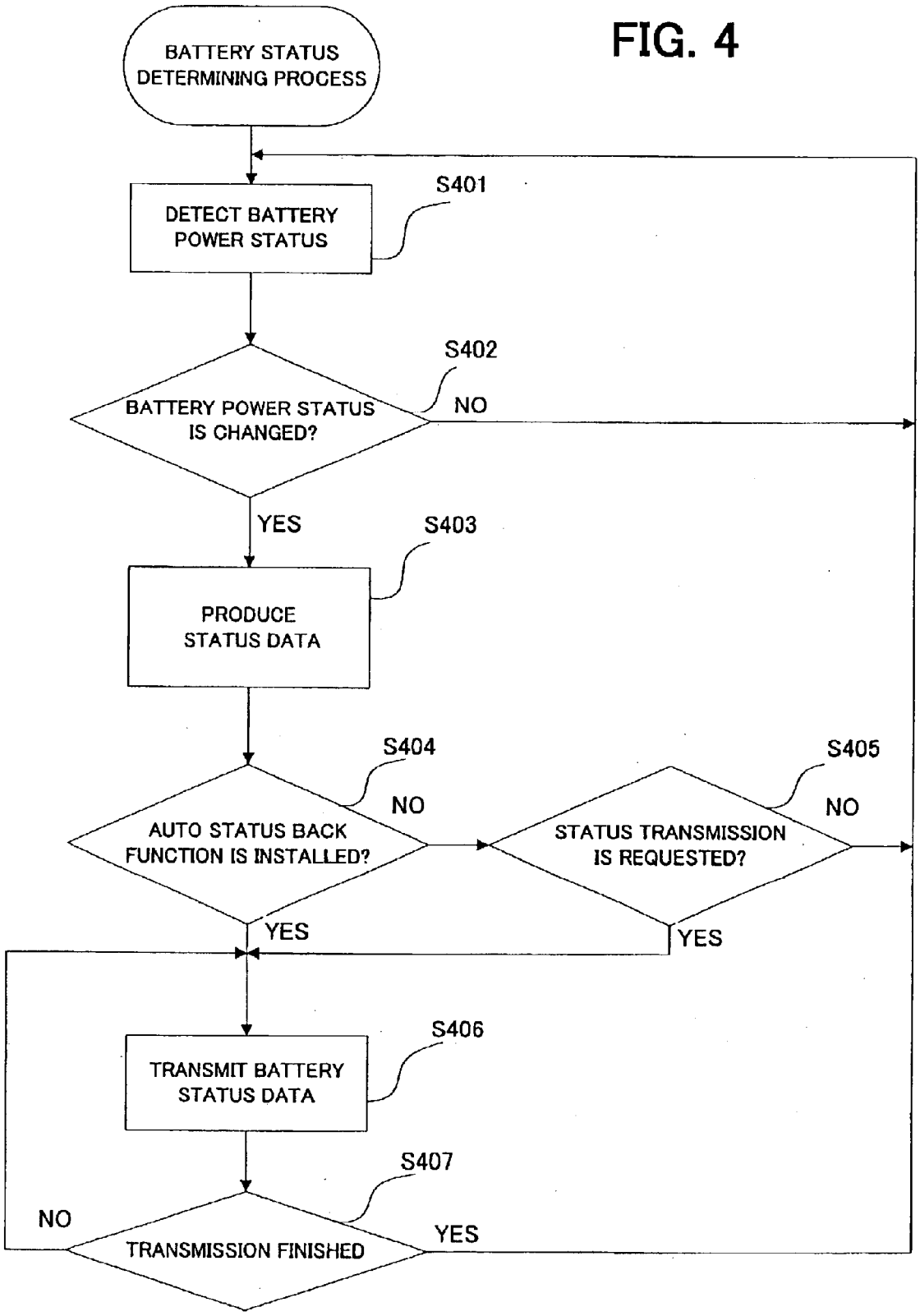
FIG. 4 is a flowchart showing a procedure of power status determining processing including producing status information data on a status of battery power in a printing apparatus and sending the data to a print controller.

FIG. 4 is a flowchart showing the procedure of the power status determining processing of producing status information data on a status of battery power in the printing apparatus 20 and sending the data to the print controller 10. The status of the battery power is continuously detected by a sensor or the like including detecting portion to detect a status of the battery power such as the battery remaining amount (S401), and it is repeatedly checked whether the remaining amount of the discharge capacity (remaining current amount) of the battery power is in the aforementioned first status, second status or third status (S402; No). When change of the battery power status is detected (S402; Yes), status information data is produced as information indicating the status of the power and stored in a predetermined storage (S403).

Then, it is determined based on a request from the print controller 10 or the like whether the printing apparatus 20 has an Auto Status Back function of the power status information (S404). When the Auto Status Back function is not set (S404; No), it is determined whether the printing apparatus 20 has received a separate power status information sending command from the print controller 10 (S405). When the printing apparatus 20 has the Auto Status Back function of status information (S404; Yes) or has received the power status information sending command (S405; Yes), it sends the produced status information data as data on a status of the battery power to the print controller 10 (S406). Until the sending of the status data is finished, the sending is repeated. When sending of the status information data is finished (S407; Yes), the processing of monitoring the battery power is started again (S401).

Figure 5:
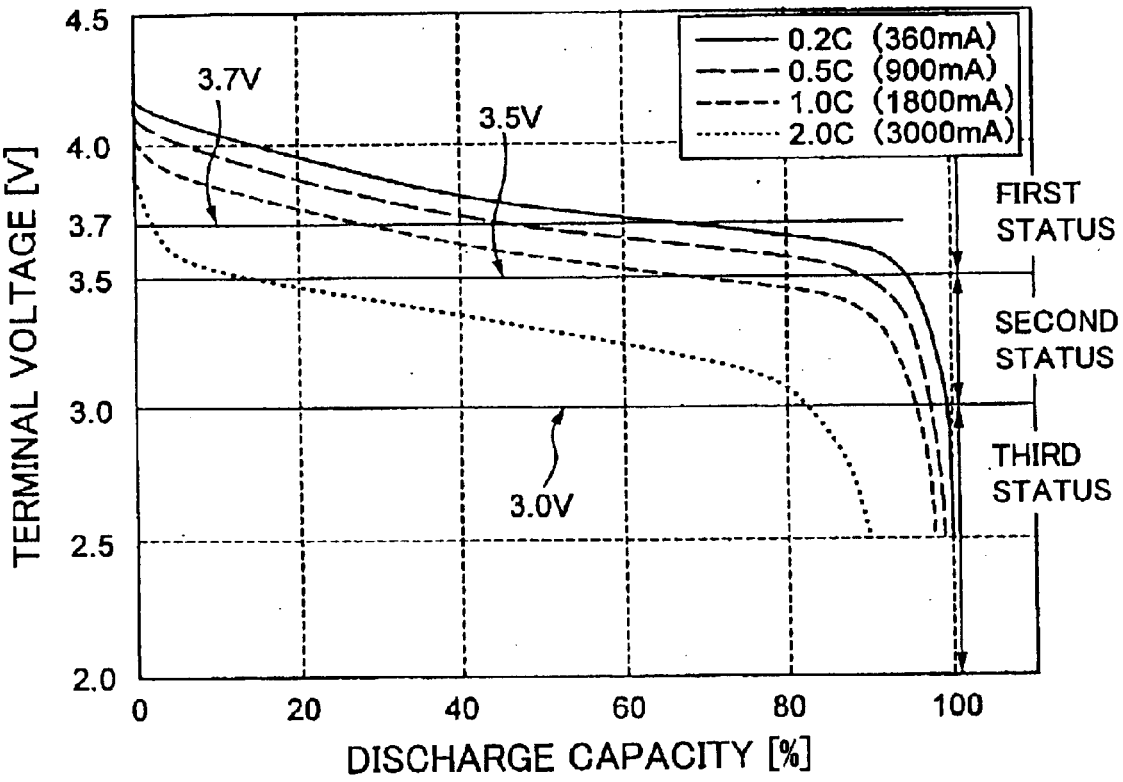
FIG. 5 is a graph showing electrical discharge of the battery power at rated output voltage of 4 V.

FIG. 5 shows electrical discharge characteristics of the battery power at rated output voltage of 4 V. For not large discharge current, for example, when the discharge is 0.2C-Rate, 0.5C-Rate, or 1.6C-Rate, the voltage is maintained 3.5 V or more until about 80% of capacity of the battery power is discharged. On the other hand, for the large discharge, i.e., 2.0C-Rate, when about 20% of the capacity of the battery power is discharged, the voltage becomes below 3.5 V, however it is after more than 80% of the capacity is discharged that the voltage becomes below 3.0 V. Accordingly, the above-described print control can be performed by setting the first status of 3.5 V or more, the second status of 3.5 V to 3.0 V and the third status of 3.0 V or less. The voltage of the first status may be set a little higher (in the order of 3.7 V) to classify the second status into a plurality of stages so as to produce status data, which allows the power saving print control to be established at about 60% of discharge capacity, thereby attention being paid to details of the print control.

FIG. 6 is a functional block diagram showing an embodiment of a printing apparatus 20 used in a printing system according to the present invention. A printing operation of the printing apparatus 20 is controlled by print data and control data sent from a print controller 10 via a communication line 40. The communication line 40 may be a radio communication line. Particularly for the printing apparatus 20 which uses battery power as driving power, the frequently used communication line is a radio communication line. The print controller 10 may not necessarily be a device dedicated to print control but may be a commonly used computer or a host device in a POS terminal system. Here in FIG. 6, an interface 30, a controlling portion 31, a printing mechanism 32, a paper feed mechanism 33, a sensor 34 and a battery 35 are only shown as a necessary part of the present invention to illustrate the printing apparatus 20. In this embodiment, the controlling portion 31 comprises a CPU, a ROM, a RAM, a logical circuit, a register and a control software stored in the ROM or the like, and these hardware and software are organically operated in synergy with each other to serve a predetermined function. The printing mechanism 32 is a mechanism for printing which includes a print head (not shown) such as a thermal print head, an inkjet head or the like.

The paper feed mechanism 33 is a mechanism for feeding print sheets (paper feed) by a step motor (not shown) or the like. The sensor 34 is a sensor including the detecting portion to detect a status of the battery power such as the battery remaining amount, provided in a predetermined position of the printing mechanism 32, the paper feed mechanism 33, the battery power 35 or the like, for detecting a paper jam, an anomaly in paper feed, a power anomaly and so on. The battery 35 is a storage battery used as power for driving the whole printing apparatus 20.

The above-described control data and print data sent from the print controller 10 are sent to a main controlling portion 21 of the controlling portion 31 via the interface 30. The main controlling portion 21 controls a transmission/reception controlling portion 22, a data analyzing portion 23, a storing portion 24, a print controlling portion 25, a paper feed controlling portion 26 for controlling paper feed, a status processing portion 27 and the whole printing apparatus 20. The transmission/reception controlling portion 22 is provided for controlling data communication with the print controller 10 in such a manner that received data is stored in a receiving buffer of the storing portion 24 and data stored in a transmission buffer is sent to the print controller 10.

The data analyzing portion 23 analyzes the received data stored in the receiving buffer, and when the received data is print data, the print data is developed in a print buffer in the storing portion 24. When the received data is control data (controlling command or the like), processing corresponding to the control data is performed by the main controlling portion 21. The print controlling portion 25 controls a print logical circuit (not shown) under the control of the main controlling portion 21 to control the operation of the printing mechanism 32 so as to execute printing. The paper feed controlling portion 26 controls paper feed so as to perform line feed in synchronization with the print control by the print controlling portion 25. The status processing portion 27 produces status data based on a signal from the sensor 34, a status of the battery 35 or a status of the receiving buffer or the like.

The battery power of the invention is preferably a lithium ion battery. The remaining amount of the battery 35 can be determined by measuring a voltage that appears across a tight-tolerance resistance inserted in serial to an output of the battery and comparing the measured voltage with a predetermined reference voltage. For example, the first status, the second status and the third status can be determined based on reference voltages of 3.5 V and 3.0 V of FIG. 5. Such a voltage sensor can be provided inside the battery 35 or as the sensor 34.

Further, the voltage across the tight-tolerance resistance inserted in serial to an output of the battery is measured, and the measurement result can be used to integrate the current value to be charged in or discharged from the battery in order to obtain the remaining current value of the battery 35. Furthermore, the voltage measured when the battery charge is small is continuously detected and stored in the storing portion 24, and then, the stored voltage is used to obtain the remaining amount. In addition, a cumulative print-head driving current is determined based on the print data and the like developed in the print buffer, while a cumulative paper feed motor driving current is determined based on the feed controlling data by feed controlling means. Then, a total sum of the cumulative print-head driving current and the cumulative paper feed motor driving current can be used to calculate a discharge amount of the battery. Furthermore, the information on the capacity of the battery power and characteristics and the like is stored in a non-volatile storage portion, the inflow and outflow current amounts in the battery power is calculated, and the current amount is cumulated and stored at every prescribed time. Then, a current capacity of the battery power may be calculated based on the stored information on the battery characteristics and the like and a cumulative inflow/ outflow current amount. Such detection and management of the remaining capacity is performed by power capacity managing portion 28, and the cumulative data is stored in the power capacity managing portion 28 or the storing portion 24.

More briefly, the voltage across a tight-tolerance resistance inserted in serial to the battery output may be measured to determine the remaining power capacity based on the measured voltage and predetermined reference voltage.

Figure 7:
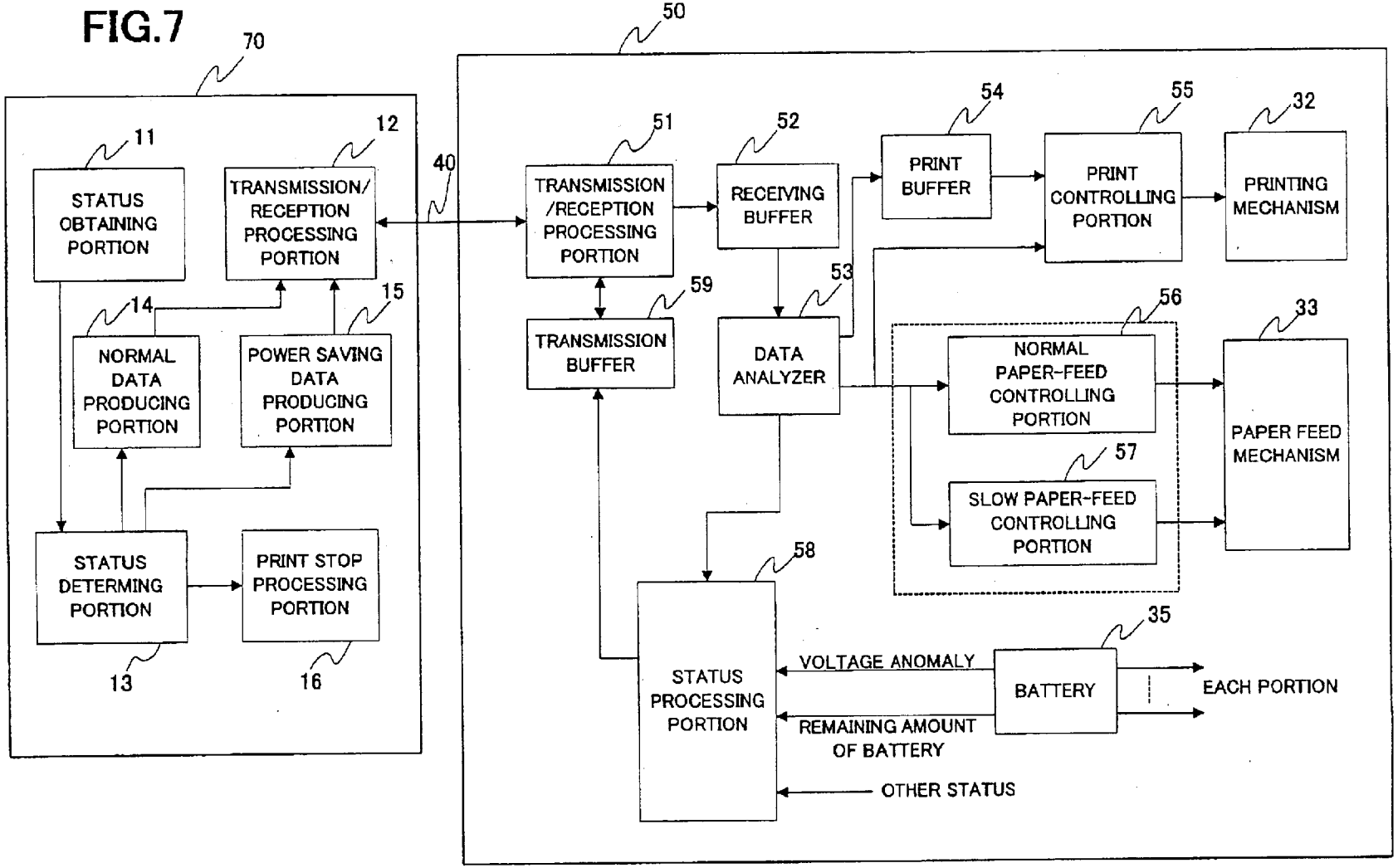
FIG. 7 is a functional block diagram showing another embodiment of the printing system according to the present invention.

FIG. 7 is a functional block diagram showing another embodiment of a printing system according to the present invention. The printing system of the present embodiment comprises a print controller 70 and a printing apparatus 50. The print controller 70 and the printing apparatus 50 are connected via a communication line such as a radio communication line or the like. In FIG. 7, a communication line 40, a printing mechanism 32, a paper feed mechanism 33 and a battery 35 are shown by similar numerals of FIG. 6. Although the printing apparatus 50 as shown in FIG. 7 has the main control portion to control over all the printing apparatus, it is deleted to simplify the drawing. Other status are signal or data output by the various sensors 34 (in FIG. 6) and print buffer 54 or the like.

The printing apparatus 50 and the print controller 70 perform data transmission/reception with each other via transmission/reception processing portions 12 and 51 which have one ends connected by the communication line 40. The print controller 70 has a status obtaining portion 11 which obtains a status indicative of the remaining of the battery 35 of the printing apparatus 50. The status information of the battery 35 of the printing apparatus 50 can be obtained by transmitting a status information sending command to the printing apparatus 50 or by utilizing the Auto Status Back function, as described above.

Once the status obtaining portion 11 obtains the status information, the obtained status information is sent to a status determining portion 13. The status determining portion 13 analyzes the status information, determines whether the battery 35 is in the first status, the second status or the third status and then, starts the processing in accordance with the determination results.

When the battery 35 is in the first status, the normal data producing portion 14 is activated to produce normal data. The normal data produced by the normal data producing portion 14 is similar to the aforementioned normal control data and normal print data. When the battery 35 is in the second status, the power saving data producing portion 15 is activated to produce power saving data. When the battery 35 is in the third status, a print stop processing portion 16 is activated to perform the processing for pausing a printing operation, as described above.

Description will now be given to the printing apparatus 50. The printing apparatus 50 receives from the print controller 70 a status information sending command or an Auto Status Back setting command, which is then stored in the receiving buffer 52 of the printing apparatus 50. The stored data is next analyzed by the data analyzer 53. When the analyzing result shows that the command is a status information sending command, the status processing portion 58 obtains information on the remaining battery amount to produce status information. The produced status information is sent to the print controller 70 via the transmission buffer 59 and the transmission/reception processing portion 51.

As described above, when the battery 35 is in the first status and the second status, the print controller 70 produces normal data and power saving data, respectively, based on the received status information, and transmits the data to the printing apparatus 50. The data sent from the print controller 70 is stored in the receiving buffer 52 of the printing apparatus 50 and analyzed by the data analyzer 53. Once it is determined by the data analyzer 53 that the data is normal print data or power saving print data, the data is stored in the print buffer 54. Upon receiving a printing command, the print data stored in the print buffer is subjected to printing with a dot pattern which is developed in the print buffer by the printing mechanism under the control of the print controlling portion 55. For the power saving print data, its print dots are thinned out by a mask pattern, and the number of print heads to be driven are correspondingly reduced by the reduced dots. Corresponding to the reduction of the print heads, the current for driving the print heads is also reduced, thereby achieving decrease in power consumption of the battery. In addition, the instantaneous discharge current is less than that for printing of normal data, which makes a voltage drop during printing smaller, holding down the degradation of printing quality involved in the voltage drop, as seen from FIG. 5.

When a line thermal printer is used and all dots are to be printed or image data is to be printed, much current is required to drive a print head. In this situation, if the data is converted into power saving print data to be printed, printing with comparatively lower discharge current can be achieved.

For normal data, feeding of print paper is performed at a rated speed by a normal paper-feed controlling portion 56. When a slow line-feed command as power saving data is received from the print controller 70, paper feed speed is controlled to be slowed by the slow paper-feed controlling portion 57. At the same time of receiving the slow line feed command as power saving data, control data is sent to the print controlling portion 55 to adjust print timing so as not to broaden a space between print lines.

Figure 8:
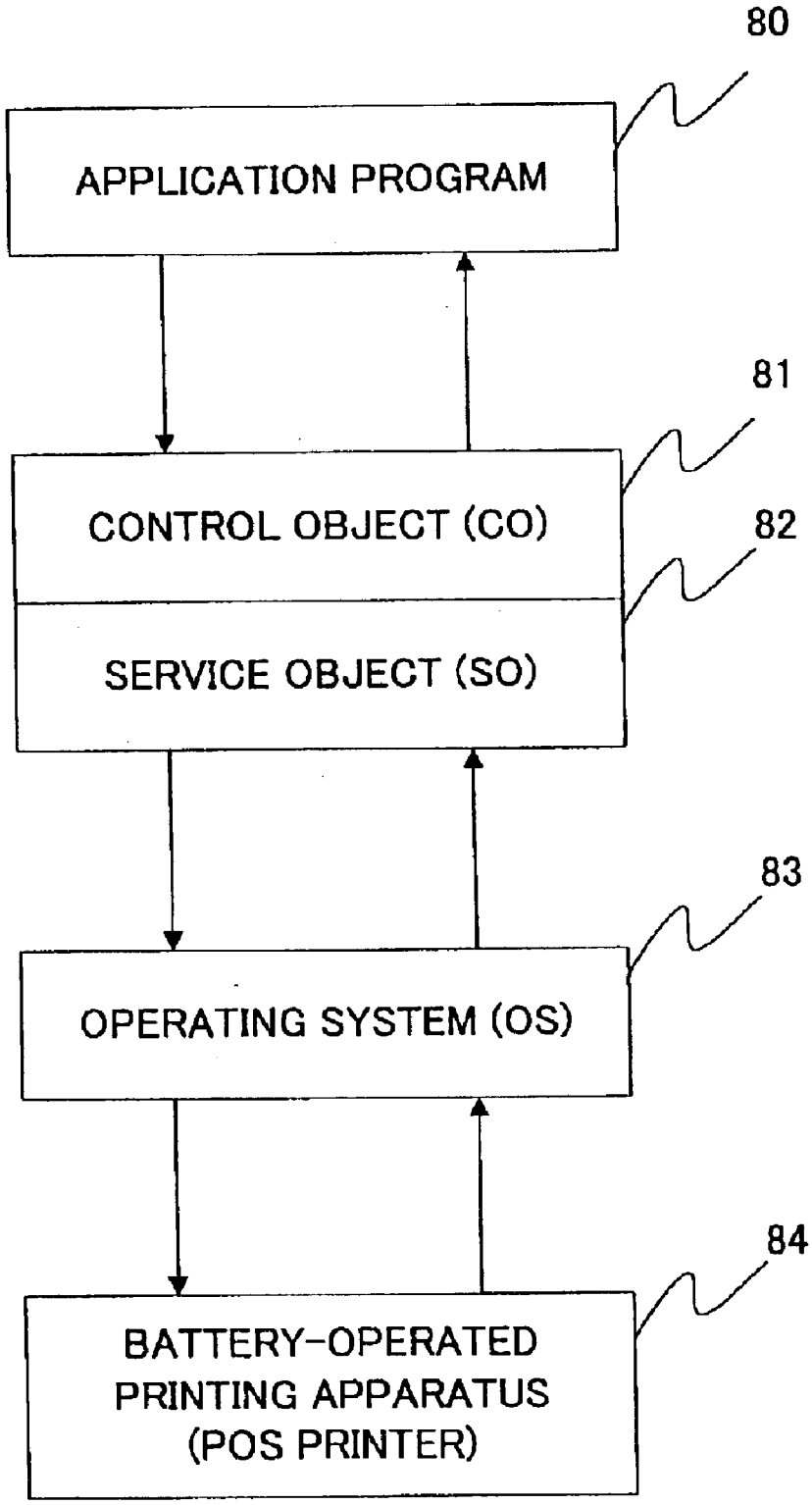
FIG. 8 is a view of a basic configuration of the OPOS.

The above-described print controllers 10 and 70 are used to collectively refer to a device for controlling a printing apparatus. For example, they may be a host device for controlling a POS printer or the like. As one example, the present invention may be applicable to a device controlling system provided by a printer driver, OLE for Retail POS (hereinafter referred to as OPOS) operated on an OS such as Windows (Trademark, hereinafter omitted) for personal computers. Such example that the present invention applies to an OPOS is described with reference to FIG. 8. FIG. 8 is a view of a basic configuration of the OPOS, showing controlling components involved in execution of printing in accordance with an application program 80 by a battery-operated POS printer 84.

The OPOS provides an interface, which is independent from models of peripherals such as a printer, to a POS application program operated on Windows based on standardized specifications. To execute print out from a POS printer 84 by the POS application program 80, first, data is sent from the application program 80 to a control object (CO) 81 of the printer. Then, the data is sent from the CO 81 to a service object (SO) 82 corresponding to a printer model then to be sent to the printer 84 via the operating system OS (Win) 83.

In the device controlling system provided by the OPOS, the service object 82 principally performs processing inherent to the printer 84. Therefore, it is by installing a battery status determining function, a normal process mode function, a power saving process mode function, a print stop mode function and the like of the present invention on the service object (SO) 82, producing appropriate data corresponding to the battery status of the printer 84 in the service object 82 and sending the data to the printer 84 via the OS 83 that the present invention can be carried out.

More specifically, when the print data is sent from the POS application program 80 to the device controlling system provided by the OPOS, the print data is converted to normal print data or power saving print data in accordance with the battery status of the printing apparatus 84 in the service object 82, and then, the converted data is sent to the printer 84 via the OS (Win) 83. Thus, conversion of the data based on the battery status being performed in the service object 82 makes it possible to control printing based on the battery status without changing each configuration of application program 80 and printer 84.

Further, the above-mentioned embodiment is not limited to printer control using the POS system, however, applicable to printer control with a general-purpose OS.

Furthermore, the printing apparatus per se may be configured to detect the battery in the second status to perform power saving mode processing. With use of this printing apparatus, normal data is only sent from the print controller and power saving print data is produced in the printing apparatus. In the power saving control, a print head may be driven at plural times to perform printing without degradation of the print resolution (printing quality).

In addition, the embodiment used in the above description is one example for explaining the present invention however not for limiting the technical scope of the present invention. Accordingly, a person skilled in the art would utilize the embodiment by modifying some or all elements of the embodiment to equivalent ones, however, such embodiment is included in the scope of the present invention.

According to the present invention, for a battery of a printing apparatus in a normal status, that is, in the first status, normal printing is performed, while for the battery in the second status where current capability is lowered, power saving control is performed so as not to place a too heavy load on the battery, for example, lowering printing quality, slowing printing speed or the like, thereby achieving accurate control of the printing apparatus operation based on the battery status.

When the battery is in the second status which is lower in current capability than the normal status, print resolution is reduced below that of the normal printing and the number of print heads to be driven simultaneously is decreased, thereby lowering power consumption. This allows printing operation to be performed with less discharge current than that for the normal printing, thereby making it possible to achieve printing even with low current capability of the battery.

Further, when the battery is in the second status, paper feed speed is lowered compared with that for the normal printing, thereby lowering power consumed by a paper feed motor. Change of the paper feed speed applies not only to the paper feed speed in printing but also to paper feed speed not involved in printing.

Furthermore, various measures to achieve lower power consumption can be taken in accordance with degradation of current capability of battery power. For example, printing control can be performed in the following manner: when there is relatively surplus current capability of the battery power, printing quality is maintained as it is as far as possible, and as the current capability becomes smaller, the printing quality is lowered.

Still further, a printing mask pattern may be formed in consideration of character dot pattern or image to be printed, thereby suppressing degradation of printing quality.

Still furthermore, even where a printing apparatus does not have an Auto Status Back function, a status of battery power of the printing apparatus can be checked on a regular basis. Or, since printing can be started after checking in advance of the battery power, it is possible, in printing a lot of data or images, to prevent interruption of printing from occurring due to lowering of battery capability.

The present invention is useful particularly in applying to a battery-operated mobile printer capable of radio data transmission/reception. For example, according to the present invention, when a portable device such as a PDA (Personal Digital Assistance) is used away from power supply to make such a printer issue a receipt or a label, it is possible to accomplish printing processing without interrupting the processing until a limit of the battery capacity is reached. In addition, by using the Auto Status Back function for reporting a status of the battery, it is possible to determine before starting printing whether the printing has to be cancelled during the processing. Accordingly, being configured to issue an alarm to an operator where the printing processing has to be cancelled, the present invention makes it possible to prevent an anomaly including interruption of the printing processing.

More specifically, in a restaurant or the like, even when a waiter receives an order at the clients' table using a PDA or a portable printer or he receives payment by a card, an operator does not feel troubles in printing such that he or she has to take care of the battery status. Besides, in issuing numbered tickets or the like outside by a printer without power supply, since a manager who is away can continuously monitor the status of the printer battery by use of the Auto Status Back function, it is possible to smoothly replace the battery in the case that the battery is dead.

For example, after a maker sells a battery-operated printer, he can provide a management service of the battery through a radio network. Specifically, where a sold printer is connected to the radio network and the maker can monitor the printer, he can know the number of times of recharging the battery by obtaining information on fluctuations of the remaining battery. Therefore, when the number of times of recharging the battery is more than predetermined (e.g. 500 times), advice <<about time to replace batteries>> can be transmitted to the printer. In addition, it is possible to examine degradation of the battery based on the number of times of recharging the battery or the status of the output voltage of the recharged battery.

As described above, the present invention allows an operation of a printing apparatus to be controlled by obtaining status information indicative of the battery status of the printing apparatus, and, when it is determined from the obtained status information that the remaining amount of the battery charge is less than the predetermined value, controlling the operation of the printing apparatus to be performed in a power saving process mode, thereby lowering power consumption of the printing apparatus. This makes it possible to utilize the remaining amount of the battery charge effectively and efficiently. Further, since a battery status can be checked before printing, the printing may be cancelled if there is a possibility that a battery might be dead during printing and there are much data to be printed.

What is claimed is:

1. A method for controlling an operation of a battery-operated printing apparatus according to a remaining amount of battery power, the printing apparatus executing required printing based on received control data and print data, which comprises steps of:

(a) obtaining status information indicating a present status of said battery power from the printing apparatus to determine a remaining amount of said battery power;

(b) establishing one of a normal process mode, a power saving process mode and a print stop mode on a basis of the determined remaining amount of the battery power, said normal process mode being established when the battery power is in a first status in which the remaining amount of the battery power is at least a predetermined amount, said power saving process mode being established when the battery power is in a second status in which the remaining amount of the battery power is lower than that of the first status, and said print stop mode being in a third status where the remaining amount of the battery power is lower than that of the second status;

(c) upon receiving a print request, producing normal data comprising normal control data and normal print data to operate the printing apparatus at rated power consumption when said normal process mode is established, or producing at least power saving data including power saving print data to enable to print at smaller power consumption than at least power consumption in said normal process mode when said power saving process mode is established; and (d) sending to said printing apparatus said normal data produced when said normal process mode is established; or sending to said printing apparatus said power saving data produced when said power saving process mode is established, wherein the second status of the battery power includes a plurality of stages corresponding to respective amounts of battery power remaining within the second status, each stage having a particular kind of power saving data associated with it, and when said power saving process mode is established in step (c), the kind of power saving data corresponding to the particular stage of the battery power is produced.

2. The method as claimed in claim 1, wherein said power saving print data comprises print data having a lower print resolution than that of normal print data.

3. The method as claimed in claim 2, wherein power saving control data is further produced as said power saving data in said power saving process mode in the step (c) above so as to feed a sheet slower than a feeding speed in said normal process mode.

4. The method as claimed in claim 3, wherein the step (a) of obtaining status information includes a step of inquiring said status information to the printing apparatus, a step of receiving said status information sent from the printing apparatus in response to the inquiry and a step of determining a status from said status information received.

5. The method as claimed in claim 2, wherein said power saving print data is produced by a logical product (AND) of said normal print data and a mask pattern to prevent prescribed dots from being printed in the step (c) above.

6. The method as claimed in claim 5, wherein said mask pattern includes a plurality of mask patterns corresponding to features of contents of printing.

7. The method as claimed in claim 5, wherein the step (a) of obtaining status information includes a step of inquiring said status information to the printing apparatus, a step of receiving said status information sent from the printing apparatus in response to the inquiry and a step of determining a status from said status information received.

8. The method as claimed in claim 2, wherein the step (a) of obtaining status information includes a step of inquiring said status information to the printing apparatus, a step of receiving said status information sent from the printing apparatus in response to the inquiry, and a step of determining a status from said status information received.

9. The method as claimed in claim 1, wherein power saving control data is further produced as said power saving data in said power saving process mode in the step (c) above so as to feed a sheet slower than a feeding speed in said normal process mode.

10. The method as claimed in claim 9, wherein said power saving print data is produced by a logical product (AND) of said normal print data and a mask pattern to prevent prescribed dots from being printed in the step (c) above.

11. The method as claimed in claim 9, wherein based on said power saving control data, a driving timing of print head is changed so as to synchronize slowed paper feed with driving of the print head.

12. The method as claimed in claim 1, wherein the step (a) of obtaining status information includes a step of inquiring said status information to the printing apparatus, a step of receiving said status information sent from the printing apparatus in response to the inquiry, and a step of determining a status from said status information received.

13. The method as claimed in claim 1, wherein said status information indicating a present status of said battery power comprises a remaining amount of said battery power obtained from a predetermined reference voltage and a voltage measured across tight-tolerance resistance inserted in serial to a battery output.

14. The method as claimed in claim 1, wherein said status information indicating a present status of said battery power comprises a remaining amount of said battery power obtained by calculating a discharge amount of the battery power based on a total sum of a cumulative print-head driving current based on said print data developed in a print buffer and a cumulative paper feed motor driving current based on feed control data of feed controller.

15. The method as claimed in claim 1, wherein said status information indicating a present status of said battery power is obtained by providing a battery information reporting function to the printing apparatus and sending a battery information sending command to the printing apparatus.

16. The method as claimed in claim 1, wherein said status information indicating a present status of said battery power is obtained by the printing apparatus, which has received in advance a command to report a status when the battery power becomes lower than a predetermined value, reporting said information status actually when the battery power becomes lower than the predetermined value.

17. The method as claimed in claim 1, wherein a mode established in accordance with a determination result of said step (a) is maintained unchanged before another determination result is obtained.

18. The method as claimed in claim 1, wherein the plurality of different kinds of power saving data include respective different kinds of mask patterns of different resolutions, one of which is selected in accordance with a status of the battery power.

19. The method as claimed in claim 1, wherein the plurality of particular kinds of power saving data include respective power saving control data for lowering the paper feed speed step by step.

20. A computer program product for controlling an operation of a battery-operated printing apparatus according to a remaining amount of battery power, the product comprising:

a storage medium readable by a processing circuit and storing instructions for execution by the processing circuit for:

(a) obtaining status information in indicating a present status of said battery power from the printing apparatus to determine a remaining amount of said battery power;

(b) establishing on of a normal process mode, a power saving process mode and a print stop mode on a basis of the determined remaining amount of battery power, said normal process mode being established when the battery power is in a first status in which the remaining amount of the battery power is at least a predetermined amount, said power saving process mode being established when the battery power is in a second status in which the remaining amount of the battery power is lower than that of the first status, and said print stop mode being in a third status here the remaining amount of the battery power is lower than that of the second status;

(c) upon receiving a print request, producing normal data comprising normal control data and normal print data to operate the printing apparatus at rated power consumption when said normal process mode is established, or producing at least power saving data including power saving print data to enable to print at smaller power consumption than at least power consumption in said normal process mode when said power saving process mode is established; and (d) sending to said printing apparatus said normal data produced when said normal process mode is established, or sending to said printing apparatus said power saving data produced when said power saving process mode is established;

wherein the second status of the battery power includes a plurality of stages corresponding to respective amounts of battery power remaining within the second status, each stage having a particular kind of power saving data associated with it, and when said power saving process mode is established in (c), the kind of power saving data corresponding to the particular stage of the battery power is produced.

21. A computer readable storage medium for controlling an operation of a battery-operated printing apparatus according to a remaining amount of battery power, the storage medium including instructions for causing a computer to implement a method comprising:

(a) obtaining status information indicating a present status of said battery power from the printing apparatus to determine a remaining amount of said battery power;

(b) establishing one of a normal process mode, a power saving process mode and a print stop mode on a basis of the determined remaining amount of the battery power, said normal process mode being established when the battery power is in a first status in which the remaining amount of the battery power is at least a predetermined amount, said power saving process mode being established when the battery power is in a second status in which the remaining amount of the battery power is lower than that of the first status, and said print stop mode being in a third status where the remaining amount of the battery power is lower than that of the second status;

(c) upon receiving a print request, producing normal data comprising normal control data and normal print data to operate the printing apparatus at rated power consumption when said normal process mode is established, or producing at least power saving data including power saving print data to enable to print at smaller power consumption than at least power consumption in said normal process mode when said power saving process mode is established; and (d) sending to said printing apparatus said normal data produced when said normal process mode is established, or sending to said printing apparatus said power saving data produced when said power saving process mode is established;

wherein the second status of the battery power includes a plurality of stages corresponding to respective amounts of battery power remaining within the second status, each stage having a particular kind of power saving data associated with it, and when said power saving process mode is established in step (c), the kind of power saving data corresponding to the particular stare of the battery power is produced.

22. A printing system capable of controlling an operation based on a remaining amount of a battery power, comprising:

a printing apparatus including a battery used as a drive source, a transmission/reception processing portion for sending and receiving data, a printing portion for executing a printing on basis of received control data and print data, a detecting portion for detecting status of said battery, and a status processing portion for producing status information which shows a remaining amount of said, battery power on a basis of a detecting signal from said detecting portion; and a print controller for controlling the printing apparatus by means of sending normal data when the battery power is in a first status in which the remaining amount of battery power is at least a predetermined amount and sending power saving data when the battery power is in a second status in which the remaining amount of battery power is lower than that of the first status, the print controller including a transmission/reception processing portion for sending and receiving data with said printing apparatus, a determining portion for obtaining the status information from the printing apparatus and determining a remaining amount of the battery power on a basis of the status information, a normal data producing portion for producing normal data to execute a print control by means of a normal process mode when the battery power is in the first status, a power saving data producing portion for producing power saving data including power saving data to enable to print at smaller power consumption than at least power consumption in said normal process mode to execute a print control by means of a power saving process mode when the battery power is in the second status, and a print stop process portion for stopping printing by means of a print stop mode when the battery power is in a third status in which the remaining amount of the battery power is lower than that of the second status;

wherein the second status of the battery power includes a plurality of stages corresponding to respective amounts of battery power remaining within the second status, each stage having a particular kind of power saving data associated with it, and when said power saving process mode is established, the kind of power saving data corresponding to the particular stage of the battery power is produced.

23. The printing system as claimed in claim 22, wherein said power saving print data comprises print data having a lower print resolution than that of normal print data.

24. The printing system as claimed in claim 23, wherein said power saving print data produced by said power saving producing portion comprises a logical product (AND) of said normal print data and a mask pattern to prevent prescribed dots from being printed.

25. The printing system as claimed in claim 24, wherein said mask pattern includes a plurality of mask patterns corresponding to features of contents of printing.

26. The printing system as claimed in claim 24, wherein said power saving data producing portion produces power saving control data for controlling a paper feed speed to perform paper feed slower than that in the normal process mode.

27. The printing system as claimed in claim 23, wherein said power saving data producing portion produces power saving control data for controlling a paper feed speed to perform paper feed slower than that in the normal process mode.

28. The printing system as claimed in claim 22, wherein said printing apparatus further comprises: a transmission reception controlling portion for controlling data communication with said print controller; a data analyzing portion for analyzing received data; a print controlling portion for controlling printing; a paper feed controlling portion for controlling paper feed; a main controlling portion for controlling the status processing portion which produces the status data.

29. The printing system as claimed in claim 28, wherein said data analyzing portion analyzes received data stored in a receiving buffer, where the received data is print data, the data is developed in a print buffer in a storage and when the received data is control data, the data is brought into the processing corresponding to the control data by said main controlling portion.

30. The printing system as claimed in claim 28, wherein said paper-feed controlling portion performs paper feed so as to allow line feed in synchronization with the print controlling by said print controlling portion.

31. The printing system as claimed in claim 28, wherein said status processing portion produces status data corresponding to a signal from a sensor, a status of the battery and a status of a receiving buffer.

* * * * *

UNITED STATES PATENT AND TRADEMARK OFFICE

CERTIFICATE OF CORRECTION

PATENT NO. : 6,851,781 B2
DATED : February 8, 2005
INVENTOR(S) : Toshihiko Yokoyama It is certified that error appears in the above-identified patent and that said Letters Patent is hereby corrected as shown below:

Title page,
Item [56], References Cited, FOREIGN PATENT DOCUMENTS, change
"JP 2000-071580 7/2000" to -- JP 2000-071580 3/2000 --

Column 14,
Line 47, insert -- , -- after "inquiry"

Column 15,
Line 65, after "information" delete "in"

Column 16,
Line 11, change "here" to -- where --

Column 17,
Line 10, change "stare" to -- stage --
Line 19, insert -- a -- after "detecting" and
Line 22, delete "," after "said"

Column 18,
Line 28, change "transmission" to -- transmission/reception --

Signed and Sealed this

Ninth Day of August, 2005

JON W. DUDAS
*Director of the United States Patent and Trademark Office*